US010434672B2

(12) United States Patent
Zhang

(10) Patent No.: US 10,434,672 B2
(45) Date of Patent: Oct. 8, 2019

(54) CUTTING TOOL

(71) Applicant: D-CUT PRODUCTS, INC., Oak Brook, IL (US)

(72) Inventor: Charlie Zhang, Oak Brook, IL (US)

(73) Assignee: D-CUT PRODUCTS, INC., Oak Brook, IL (US)

( * ) Notice: Subject to any disclaimer, the term of this patent is extended or adjusted under 35 U.S.C. 154(b) by 0 days.

(21) Appl. No.: 15/664,932

(22) Filed: Jul. 31, 2017

(65) Prior Publication Data

US 2019/0030747 A1 Jan. 31, 2019

(51) Int. Cl.

| | |
|---|---|
| ***B26D 1/08*** | (2006.01) |
| ***B26D 3/06*** | (2006.01) |
| ***B26D 5/10*** | (2006.01) |
| ***B26D 5/16*** | (2006.01) |
| ***B26D 7/26*** | (2006.01) |

(52) U.S. Cl.

CPC ..... *B26D 1/08* (2013.01); *B26D 3/06* (2013.01); *B26D 5/10* (2013.01); *B26D 5/16* (2013.01); *B26D 7/2628* (2013.01); *Y10T 83/2216* (2015.04); *Y10T 83/885* (2015.04); *Y10T 83/8843* (2015.04)

(58) Field of Classification Search

CPC ..... Y10T 83/2216; Y10T 83/8843; Y10T 83/8805; Y10T 83/885; B26D 3/283; B26D 2003/285; B26D 2003/288; B26D 7/2628; B26D 5/16; B26D 5/10; B26D 1/08; B26D 1/085; B26D 3/06; B27G 5/023

USPC ..... 83/764–767, 856, 436.2, 165, 157, 781, 83/633, 473, 474, 432, 477; 451/414

See application file for complete search history.

(56) References Cited

U.S. PATENT DOCUMENTS

| | | | | |
|---|---|---|---|---|
| 1,534,957 | A * | 4/1925 | Hurley | B27G 5/02 83/766 |
| 1,985,614 | A * | 12/1934 | Merrigan | G01B 3/56 33/500 |
| 2,496,018 | A | 1/1950 | Pearson | |
| 2,697,488 | A | 12/1954 | Stempel | |
| 3,151,515 | A | 10/1964 | Suverkrop | |
| 3,279,295 | A | 10/1966 | Teplitz | |
| 3,580,123 | A | 5/1971 | Westra et al. | |
| 3,678,581 | A | 7/1972 | Bolduc | |
| 3,690,208 | A | 9/1972 | Muller | |
| 3,702,016 | A | 11/1972 | Keesee | |

(Continued)

FOREIGN PATENT DOCUMENTS

| | | |
|---|---|---|
| DE | 24 44 505 A1 | 4/1976 |
| DE | 40 24 615 A1 | 2/1992 |

(Continued)

*Primary Examiner* — Laura M Lee

(74) *Attorney, Agent, or Firm* — Pauley Erickson & Kottis

(57) ABSTRACT

A cutting tool for cutting building materials at a range of angles from vertical and/or horizontal and with an additional adjustment mechanism for adjusting the cutting angle up or down by a small angle. More specifically, this invention relates to a cutting tool including a base, a support surface, and a cutting platform, where the cutting platform can be set at a plurality of angles to the base including, but not limited to, angles of 22.5°, 30°, 45°, and 90°, and the support surface can be angled slightly up or down by a small amount, for example 1° or 2°, to slightly adjust an angle of the cut.

15 Claims, 17 Drawing Sheets

FIG. 2

(56) References Cited

U.S. PATENT DOCUMENTS

| | | | | |
|---|---|---|---|---|
| 3,726,164 | A | 4/1973 | Cocquebert | |
| 3,785,233 | A | 1/1974 | Robinson | |
| 4,328,728 | A * | 5/1982 | Ferdinand | B23D 45/042 83/471.3 |
| 4,480,529 | A | 11/1984 | Winkler et al. | |
| 4,503,743 | A | 3/1985 | Ryba | |
| 4,513,501 | A | 4/1985 | Lee | |
| 4,579,027 | A | 4/1986 | Lewis | |
| 4,608,900 | A | 9/1986 | Guiu et al. | |
| 4,936,177 | A | 6/1990 | Ozawa et al. | |
| 5,038,477 | A | 8/1991 | Parrow | |
| 5,255,587 | A | 10/1993 | Eichenberg et al. | |
| 7,103,979 | B2 * | 9/2006 | Yoshida | B23D 59/006 30/376 |
| 7,204,179 | B1 | 4/2007 | Meyer | |
| 8,272,133 | B2 * | 9/2012 | Wascow | B27B 9/02 30/376 |
| 9,180,600 | B2 | 11/2015 | Zhang | |
| 2004/0089126 | A1 | 5/2004 | McLean et al. | |
| 2009/0007746 | A1 | 1/2009 | Gunn | |
| 2009/0223067 | A1 | 9/2009 | Zhang | |
| 2009/0301277 | A1 | 12/2009 | Ipatenco et al. | |
| 2010/0263512 | A1 | 10/2010 | Zhang | |
| 2015/0135924 | A1 | 5/2015 | Zhang | |
| 2015/0143969 | A1 | 5/2015 | Zhang | |
| 2016/0144522 | A1 | 5/2016 | Zhang | |
| 2016/0263759 | A1 | 9/2016 | Zhang | |

FOREIGN PATENT DOCUMENTS

| | | |
|---|---|---|
| DE | 20 2004 013 650 U1 | 11/2004 |
| DE | 20 2006 012 879 U1 | 12/2006 |
| DE | 20 2008 002 459 U1 | 8/2009 |
| EP | 1 762 347 A2 | 3/2007 |
| FR | 847014 | 10/1939 |
| FR | 2 055 838 | 5/1971 |
| FR | 2 576 054 | 7/1986 |

* cited by examiner

CUTTING TOOL

BACKGROUND OF THE INVENTION

Field of the Invention

This invention relates to a cutting tool for cutting sheets of building materials, for example laminate, at a range of angles from vertical and/or horizontal.

Discussion of Related Art

Users cut building materials, such as baseboards and crown molding, with a beveled or mitered cut in order to fit in or around corners. FIG. 1*a* shows a representation of materials 100, for example baseboards, properly aligned with 45° angle cuts. However, in some instances, the cut baseboards do not properly fit for a flush finish, due to imperfections in walls and other factors, causing an unsightly gap at an exposed corner of the adjoining cuts. FIG. 1*b* shows an example of improperly aligned baseboards. Ideally, the cuts are adjusted to align, as shown in FIG. 1*a*. Other times such a finish is not possible and users will adjust the angle of the mitered cut so that the baseboards meet at the exposed corner and allow for a gap at an interior hidden portion of the baseboards. FIG. 1*c* shows an example of a compensated cut with a proper fit at an exposed corner of the baseboards. Currently, users make this compensated cut by placing a shim under the baseboard to reduce the cutting angle by a small amount. However, this method of compensation is imprecise and does not allow for compensation by slightly increasing, rather than decreasing, the cutting angle. As such, there is a need for an improved cutting tool for cutting building materials with a beveled cut and allowing the cut angle to be slightly adjusted to compensate for misaligned cuts.

SUMMARY OF THE INVENTION

The present invention provides a portable, non-power operated cutting tool for cutting sheets of building materials at a range of angles in both a vertical and horizontal direction without splintering or cracking. The present invention also allows for fine adjustment of the cutting angle by pivoting a support surface up or down to change the angle of the cut to allow abutting materials to properly align.

According to an embodiment of this invention, the cutting tool includes a cutting platform that includes an axle that allows both a base and a table support surface to be pivotally connected to the cutting platform. This design allows for rotational adjustment of the cutting platform, the base, and the table support surface relative to one another. Preferably, large angular adjustments are provided by moving the cutting platform relative to the base and locking the cutting platform in place. Small, compensating angles are provided by moving the table support surface relative to the base and locking the table support surface in place. The locking mechanism is preferably easily releasable, allowing the cutting tool of this invention to be easily and repeatedly set to cut a plurality of different angles.

The cutting platform of this invention preferably includes a cutting platform base with a pair of supports extending vertically from the cutting platform base. The supports are preferably positioned on either side of the cutting platform with a beam and a cam positioned to rotate between the supports. A blade holder and a blade are positioned under and in contact with the cam and designed to move along the supports of the cutting platform. To maintain a straight path of travel, each edge of the blade holder at least partially surrounds a respective support. The blade holder and the blade are moveable between an open position and a closed, cutting position, by rotating the cam. In the open position, the cam contacts the blade holder at a relatively small radius so that as the cam rotates, the blade holder contacts the cam at a gradually increasing radius until the blade holder and the blade are forced downward contacting a blade stop in the cutting platform base. For ease of operation, the blade holder and blade are biased into the open position with springs positioned under the blade holder and preferably with one spring surrounding each of the supports.

In a preferred embodiment, a handle is connected to the beam to assist in rotating the cam. The handle may adjustable, allowing for the handle to move through a full range of motion, from the open position to the closed position, for all angled cuts.

As discussed above, the cutting tool of this invention includes a device for temporarily locking the cutting platform at an angle to the base. In one embodiment, this device comprises a plate secured to an end of the axle and a latch pivotally mounted to the base. The plate includes a plurality of slots positioned along an outer edge, each slot used to set the cutting platform at an angle to the base. The latch engages with the slot to prevent further rotation of the axle. As the cutting platform and, in turn, the plate rotates, each slot also moves in and out of proximity with the latch mounted to the base. When a desired angle of the cutting platform is reached, the latch engages the respective slot in the plate to temporarily lock the cutting platform at a desired angle to the base. In a preferred embodiment, the plate includes at least four slots allowing the cutting platform to set at a right angle (marked as zero in the figures) to the base, at a 22.5° angle, at a 30° angle, and at a 45° angle to the base. However, it should be understood that the cutting tool of this invention is not limited to four slot or the identified angles and may comprise any number of slots defining any range of angles.

As discussed above, the cutting tool of this invention also includes a device for temporarily locking the table support surface at an angle to the base. In one embodiment, the table support surface includes a rack mounted on a bottom side (opposite side from the side that supports the material being cut). In this embodiment, the rack includes a plurality of grooves, each groove used to set the table surface at a fine angle to the base. For example, each groove may be used to set a 1° change of angle of the table support surface to the base. To temporarily hold the table in position, a releasable plunger is mounted to the base. The releasable plunger connector engages one of the plurality of grooves to lock the table surface at the fine angle to the base. In one embodiment, the rack and releasable plunger may be used to set the angle at +2°, +1°, 0, −1°, and −2°. However, the cutting tool of this invention is not limited to the identified angles and other angles may be selected.

As the cutting platform, the base, and the table support surface all rotate relative to one another, it is preferred that the blade moves in a plane that is co-planar with a centerline of the axle and the blade contacts a blade stop, in the cutting platform base, along a line that is collinear with the axis of rotation of the axle. This alignment prevents unintended movement of any of the cutting platform, the base, or the table support surface as the blade completes the cutting motion, preventing splintering and/or cracking of the material being cut.

According to a preferred embodiment of this invention, the base further includes a guide rail for aligning the building material to the blade. The guide rail is adjustable, allowing the building material to set at a range of angles to the blade in a horizontal plane.

BRIEF DESCRIPTION OF THE DRAWINGS

These and other objects and features of this invention will be better understood from the following detailed description taken in conjunction with the drawings, wherein.

DESCRIPTION OF THE INVENTION

Figure 1A:
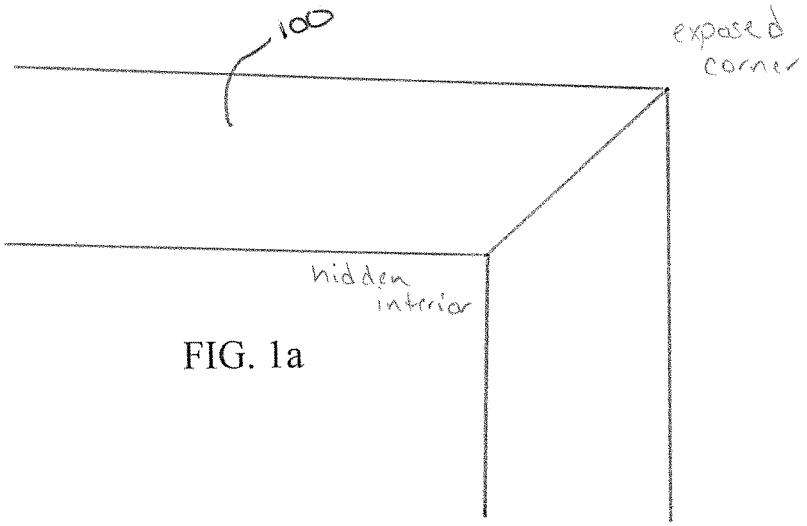
FIG. 1*a* shows a representation of baseboards properly aligned with 45° angle cuts.
Figure 1B:
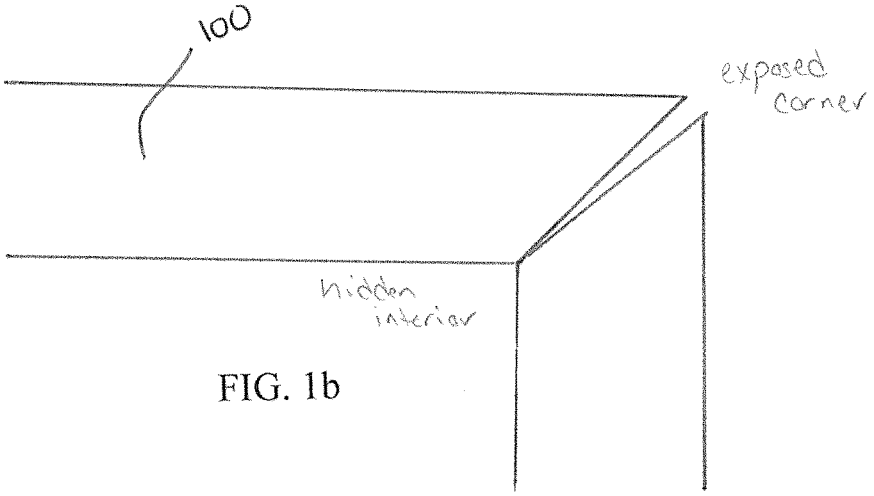
FIG. 1*b* shows a representation of baseboards misaligned with 45° angle cuts.
Figure 1C:
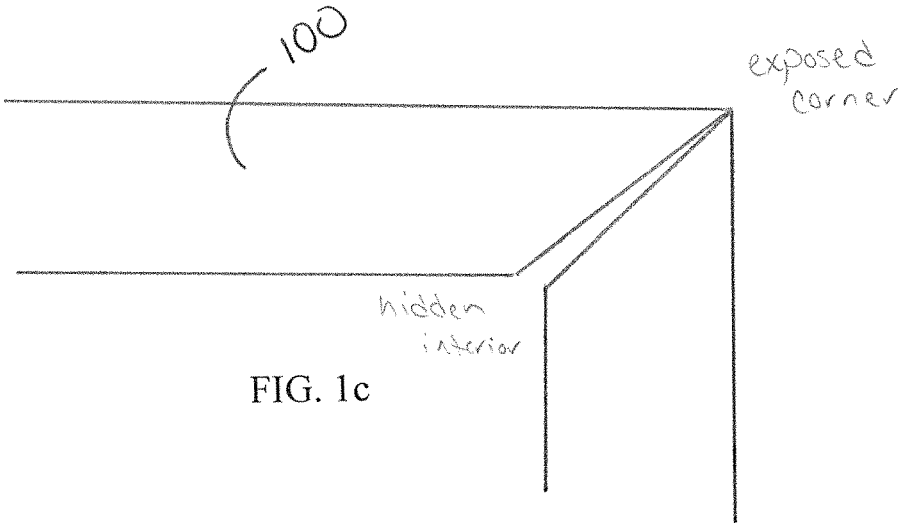
FIG. 1*c* shows a representation of baseboards joined with a compensated 45° angle cuts.

A cutting tool 10 of this invention is preferably used to cut building materials 100, such as laminate, in a predictable and straight fashion without splintering, cracking or similar problems that may arise from such cuts. As used herein, "building material" refers to a sheet or plank of building material, such as baseboards, crown molding, chair rail molding, wood flooring, laminate flooring, composite flooring, vinyl flooring, vinyl siding, vinyl composition tile, dimensional lumber or similar materials, including, but not limited to, one or more combinations of wood, fiber, vinyl, concrete, rubber, plastic and/or other materials that may or may not include a laminated layer.

The cutting tool 10 is preferably capable of cutting building materials 100 at a plurality of angles to a table surface 12 including, but not limited to, 0° (right), 22.5°, 30°, and 45° angles. However, it should be understood that the cutting tool 10 of this invention is not limited to the listed angles and may be used to cut other angles. In a preferred embodiment, the cutting tool of this invention allows for an angle of a table surface to be adjusted slightly, for example by 1 or 2 degrees up or down, to change a cutting angle of the cutting tool 10 in order to compensate for misaligned materials, for example misaligned baseboards. The cutting tool 10 of this invention is also capable of cutting building materials at a range of angles in a horizontal plane, with a guide rail 28 set perpendicular to the blade or at a range of angles including 22.5°, 30°, 45° and/or other angles. The vertical adjustment allows the cutting tool 10 to cut materials to, for example, fit around or in corners of a room and the horizontal adjustment allows the cutting tool 10 to cut materials to, for example to fit around window or door frames.

As shown in FIGS. 2-17, the cutting tool 10 includes a base 14, the table surface 12, a cutting platform 16, a blade holder 18 and blade 20, and a handle 22. The cutting platform 16 and the base 14 are preferably connected with an adjustable, lockable, pivotable connection allowing the cutting platform 16 to be set at a plurality of angles relative to the base 14. For example, the pivotable connection may comprise a hinge, an axle or any other connection that allows the cutting platform 16 to pivot relative to the base 14. The table surface 12 is also preferably connected to at least one of the base 14 or the cutting platform 16 with a hinge allowing the table surface to set at an angle to a plane of the blade 20. In a preferred embodiment, the table surface 12, the base 14, and the cutting platform 16 all rotate about the same axis of rotation.

In an embodiment of the invention, the base 14 comprises a rectangular base that provides stability for the cutting tool 10, however the base 14 is not limited to this shape and may comprise any shape that provides stable support for the cutting tool 10. The base 14 may be formed of steel, aluminum or another material with durable qualities capable of withstanding the force required to cut the building materials. In this embodiment, the base 14 also includes a plurality of wheels for moving the tool 10.

In an embodiment of this invention, the table surface 12 is connected to at least one of the cutting platform 16 or the base 14 and supports the building material 100 to be cut. The table surface 12 preferably includes a textured or a high friction, non-slip surface that prevents the building material from slipping or moving during the cutting process. The table surface 12 is preferably made of lightweight and durable materials, such as plastic, rubber, metal and/or composite materials, but may be made of any material capable of supporting the building materials and withstanding the cutting force generated by the cutting tool 10. The base 14 and table surface 12 are preferably sized to accommodate standard sizes of materials, such as a baseboard, and may correspond in width to such material.

The cutting tool 10 preferably further includes a guide rail 28 positioned on the table surface 12. The guide rail 28 can be used to align the building material at a range of angles, on a horizontal plane, to the blade 20. In the embodiment shown in FIG. 2, the guide rail 28 is positioned perpendicular to the blade 20. However, the guide rail 28 can be set in two or more of a plurality of holes in the table surface 12 to set the guide rail 28 to a range of angles relative to the blade 12 including, but not limited to, a 90°, 45°, 30°, and/or 22.5° angle. The table surface and/or the guide rail may further include a ruler for measuring the material to be cut.

Figure 2:
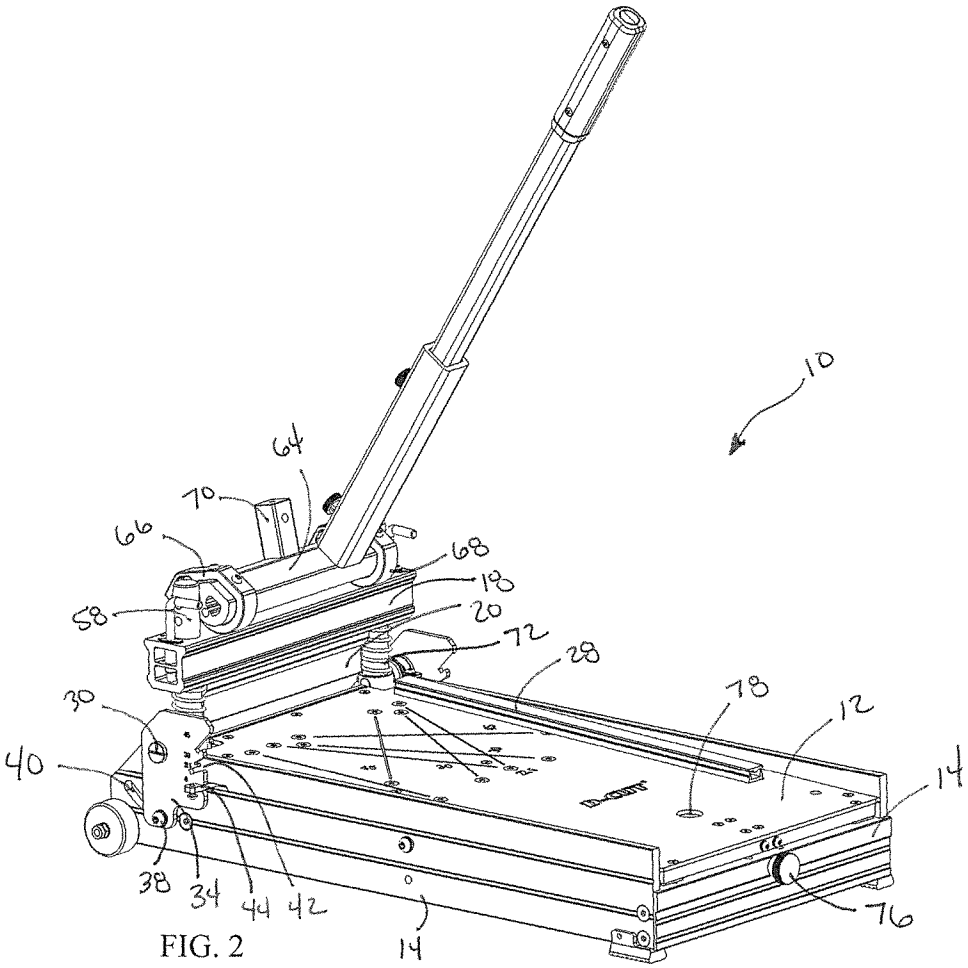
FIG. 2 is a perspective view of a cutting tool according to one embodiment of this invention with a blade set to cut at a right angle and a table surface angled downward 2°.
Figure 11:
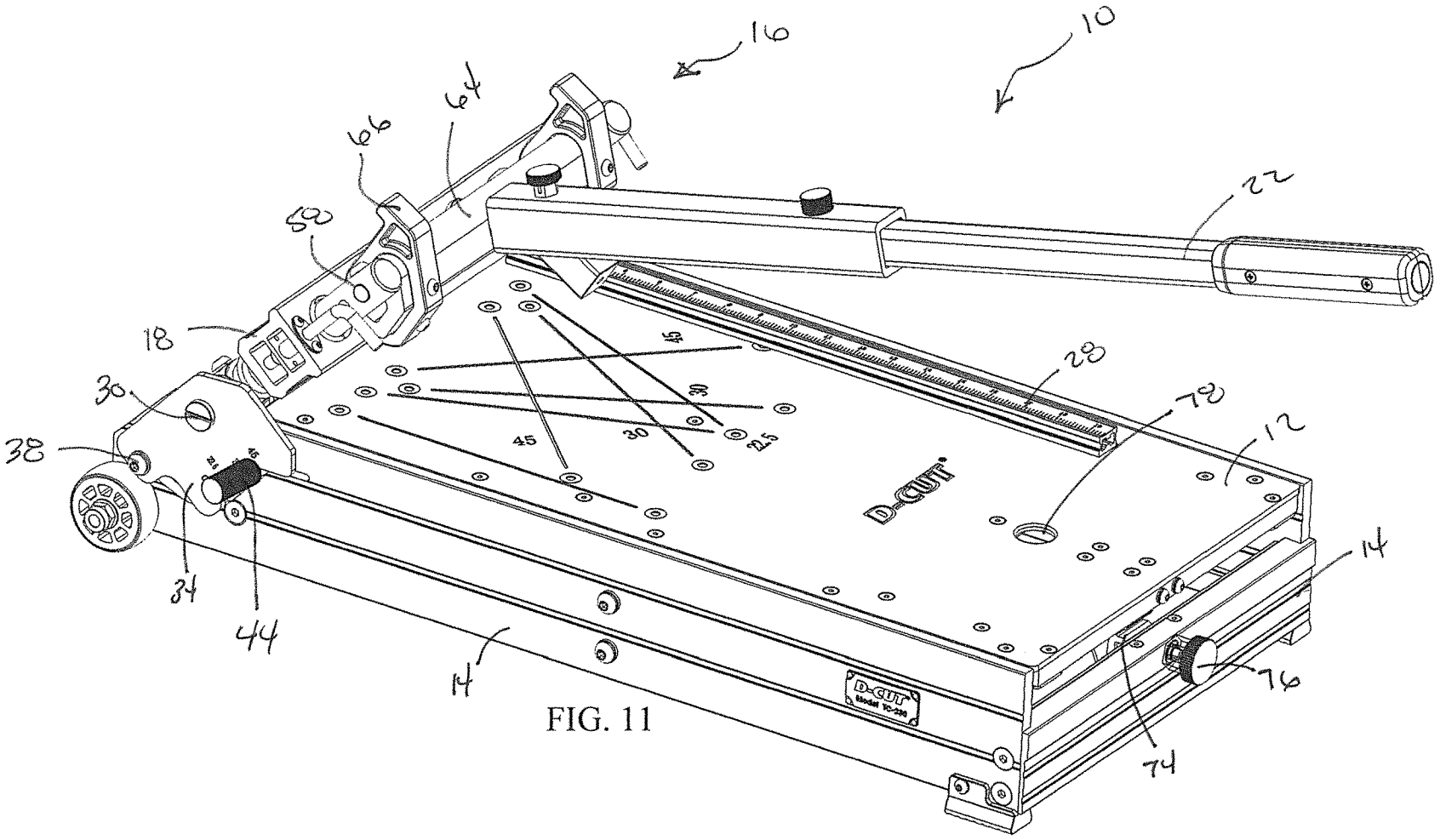
FIG. 11 is a perspective view of the cutting tool shown in FIG. 2 with the blade set to cut at a 45° angle and the table surface set at 0°.
Figure 12:
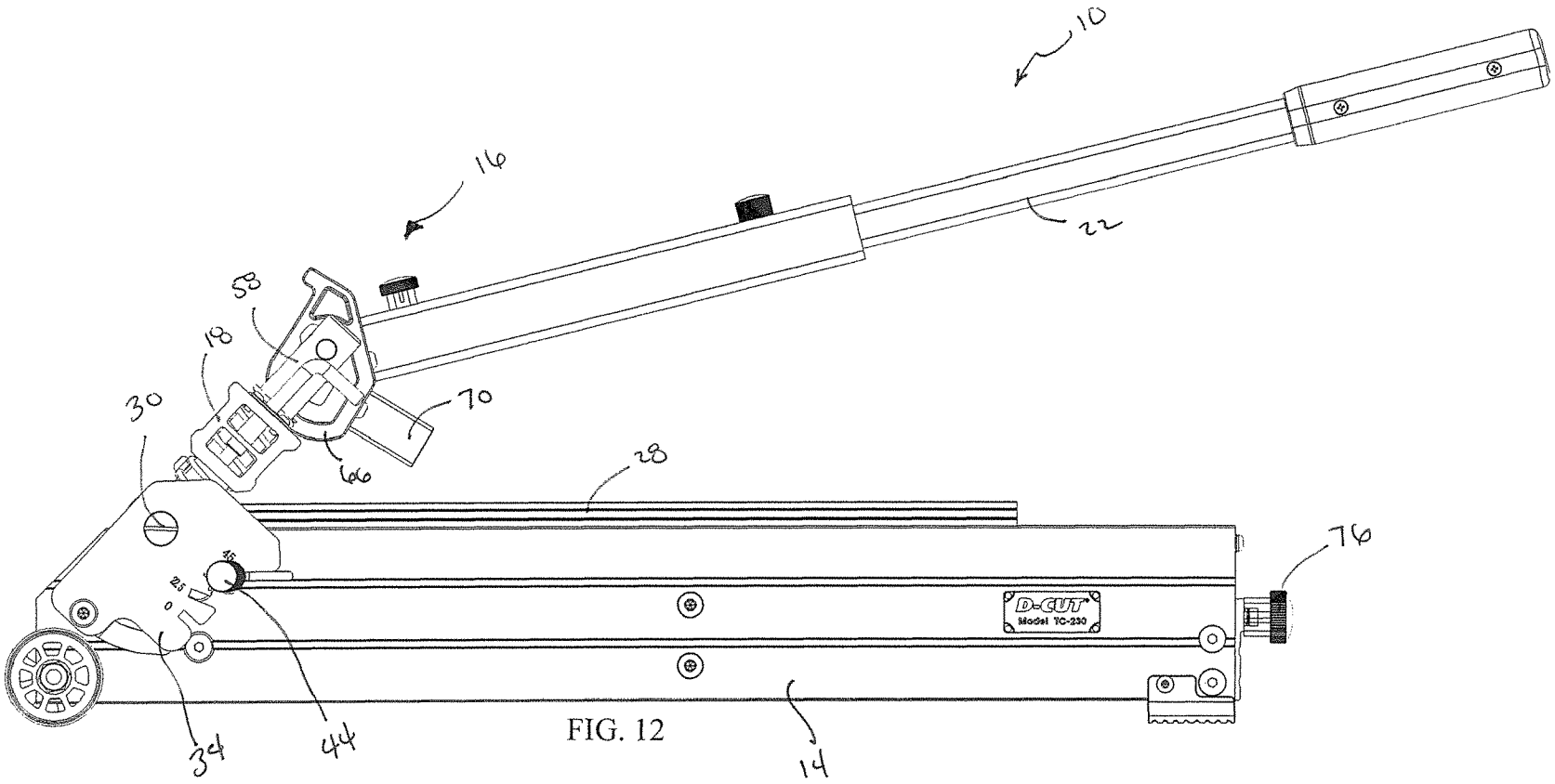
FIG. 12 is a side view of the cutting tool shown in FIG. 11.
Figure 15:
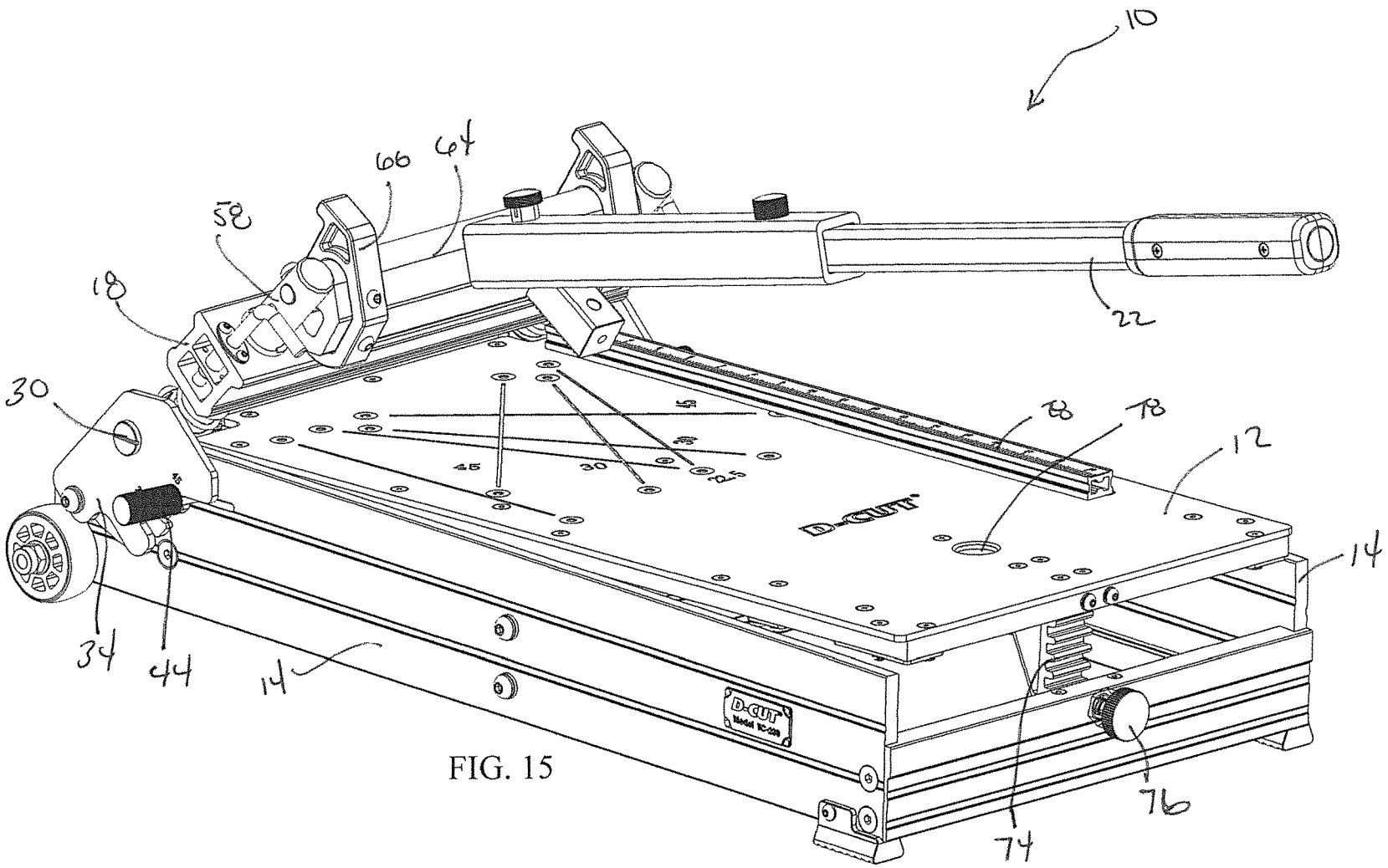
FIG. 15 is a perspective view of the cutting tool shown in FIG. 2 with the blade set to cut at a 45° angle and the table surface angled upwards 2°.
Figure 16:
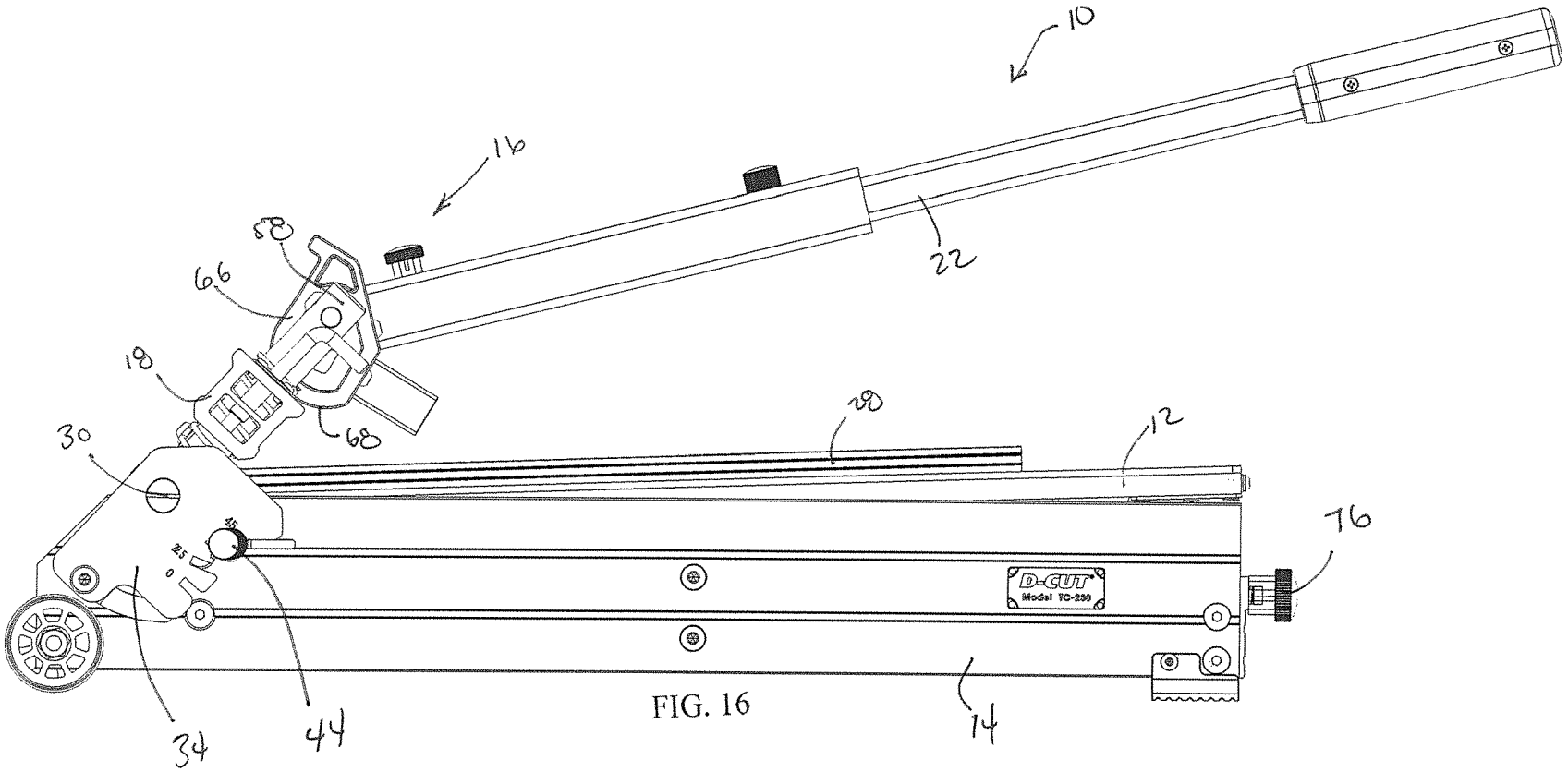
FIG. 16 is a side view of the cutting tool shown in FIG. 15.

As discussed above, the cutting platform 16 is connected to the base 14 with a pivotable connection allowing the cutting platform 16 to be set at a plurality of angles relative to the base 14 allowing the blade 20 to cut at a plurality of angles. For example, FIG. 2 shows the cutting platform 16 aligned with the base 14 for a vertical cut or 0° cut and FIGS. 11 and 15 show the cutting platform 16 aligned with the base 14 for a 45° cut. In the embodiment shown in the figures, the cutting platform 16 can be set at a plurality of angles including 0°, 22.5°, 30°, and 45°. However, the cutting tool 10 of this invention is not limited to the listed angles and can be designed to cover any range of angles.

The cutting platform 16 preferably includes a cutting platform base 54, a blade stop 56, a pair of supports 58 extending from the cutting platform base 54, a beam 64 extending between the pair of supports 38, and a cam 66 mounted to the beam. The cam 66 further includes a cam edge 68 with at least two radii and preferably with a gradually increasing radius. The cutting platform 16 is preferably manufactured of steel but may comprise any material or materials capable of withstanding the force required to push the blade 20 through the building material 12.

Figure 7:
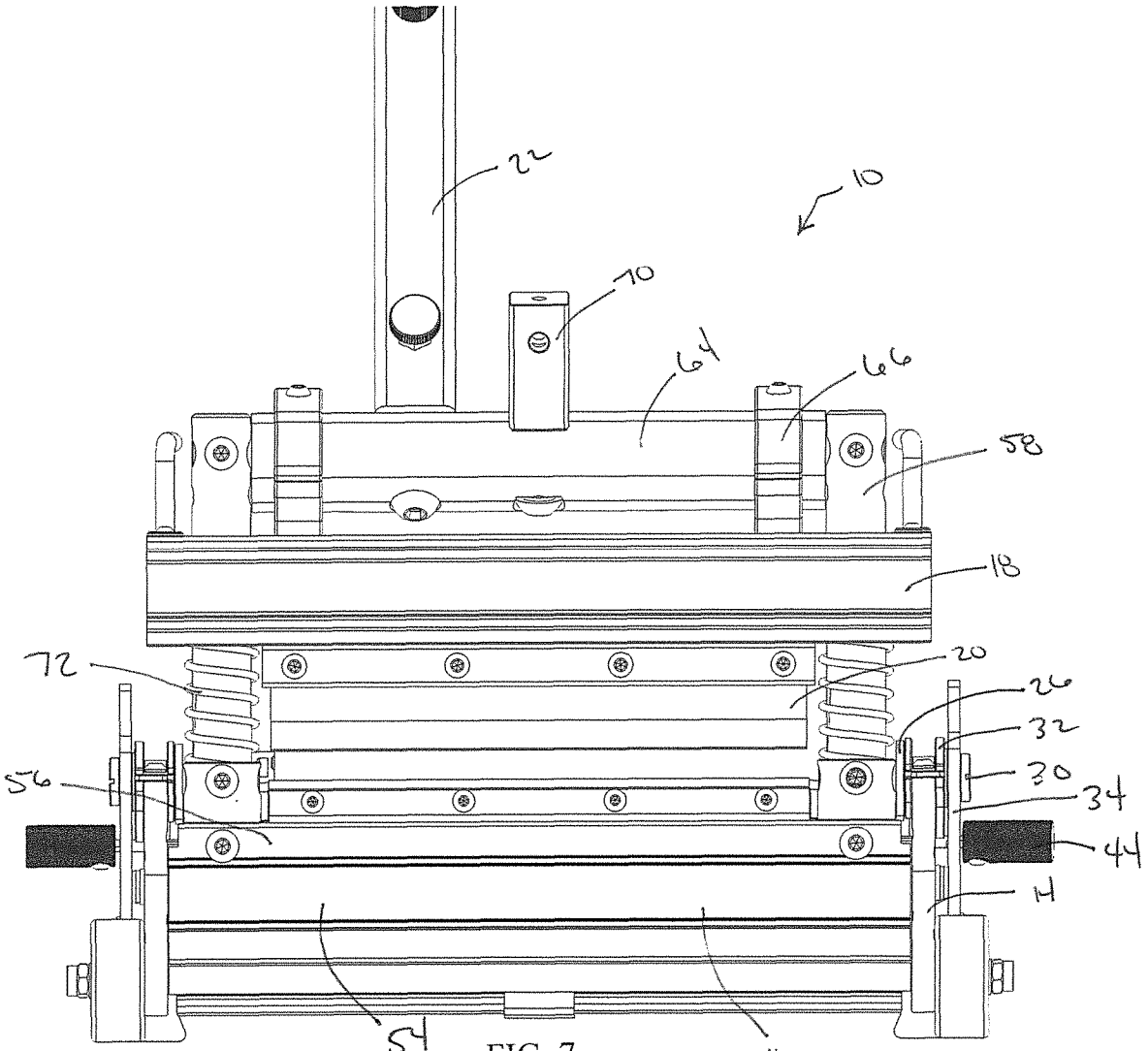
FIG. 7 is an end view of the cutting tool shown in FIG. 2.

As best shown in FIG. 7, the pair of supports 58 are connected to the cutting platform base 54 extending generally perpendicular to a plane of the blade stop 56. The pair of supports 58 may be formed of materials such as steel or similar rigid material. In this embodiment, the pair of supports 58 are integrally formed with the cutting platform base 34 and are positioned on either side of the cutting platform base 54 at a width sufficient to accommodate standard sizes of material, such as but not limited to base boards and crown molding. In other embodiments, the pair of supports 58 can be welded to or connected with a mechanical connection, such as a threaded connection, to the cutting platform base 54 or connected in any other means known to one of skill in the art.

In a preferred embodiment, this invention includes the handle 22 attached to the beam 50 to assist a user to rotate the beam 50 and the cam 66. In a preferred embodiment, the beam 50 includes a plurality of connections 70. The plurality of connections 70 allows the handle 22 to be set in at least two positions to compensate for the angle of the cutting platform 16, allowing the handle 22 to rotate fully from the open position to the closed position and to prevent the handle 22 from contacting the base 14. In an alternative embodiment, the handle may not include the adjustable connection and the attachment can be formed in various ways including, but not limited to, a threaded connection, a welded connection or an integral connection with the beam 50. The handle 22 preferably further includes a hand grip for the user to manually grab or engage. In an alternative embodiment, the handle 22 may be extendible to provide a longer lever for cutting the material.

As shown in the figures, the blade holder 18 and the blade 20 are positioned between the pair of supports 58, where the pair of supports act as guides for the blade holder 18 to maintain a generally straight path as the blade holder 18 moves from the open position to the closed position. The blade holder 18 may be formed of a material such as steel or similar rigid material. The blade 20 is preferably formed of steel or another material capable of repeatedly cutting all thicknesses and compositions of materials. In a preferred embodiment, the blade 20 is attached to the blade holder 18 with a threaded connection. With this arrangement, the blade 20 can be removed from the blade holder for repairs, sharpening and to select a specialty blade for any type of material. In an alternative embodiment, the blade 20 can be integrally formed with the blade holder 18.

As best shown in FIG. 7, each outer edge of the blade holder 18 at least partially surrounds a respective support 58. The blade holder 18 is positioned under and in contact with the cams 66. As each cam 66 rotates, the increasing radius of the cam edge 68 forces the blade holder 18 downwards from the open position to the closed position.

According to a preferred embodiment, the blade holder 18 and blade 20 are biased upward into the open position by a spring 72. As shown in the figures, the spring 72 is positioned between the cutting platform 16 and the blade holder 18. In this embodiment, each spring 72 wraps around the support 58. In an alternative embodiment, the spring 72 may not wrap around the support 58. As the blade holder 18 travels downward, the spring 72 is compressed to further urge a uniform cut of the blade 20 through the material to be cut. The strength and configuration of the spring 72 may be adjusted depending on the desired application.

Figure 8:
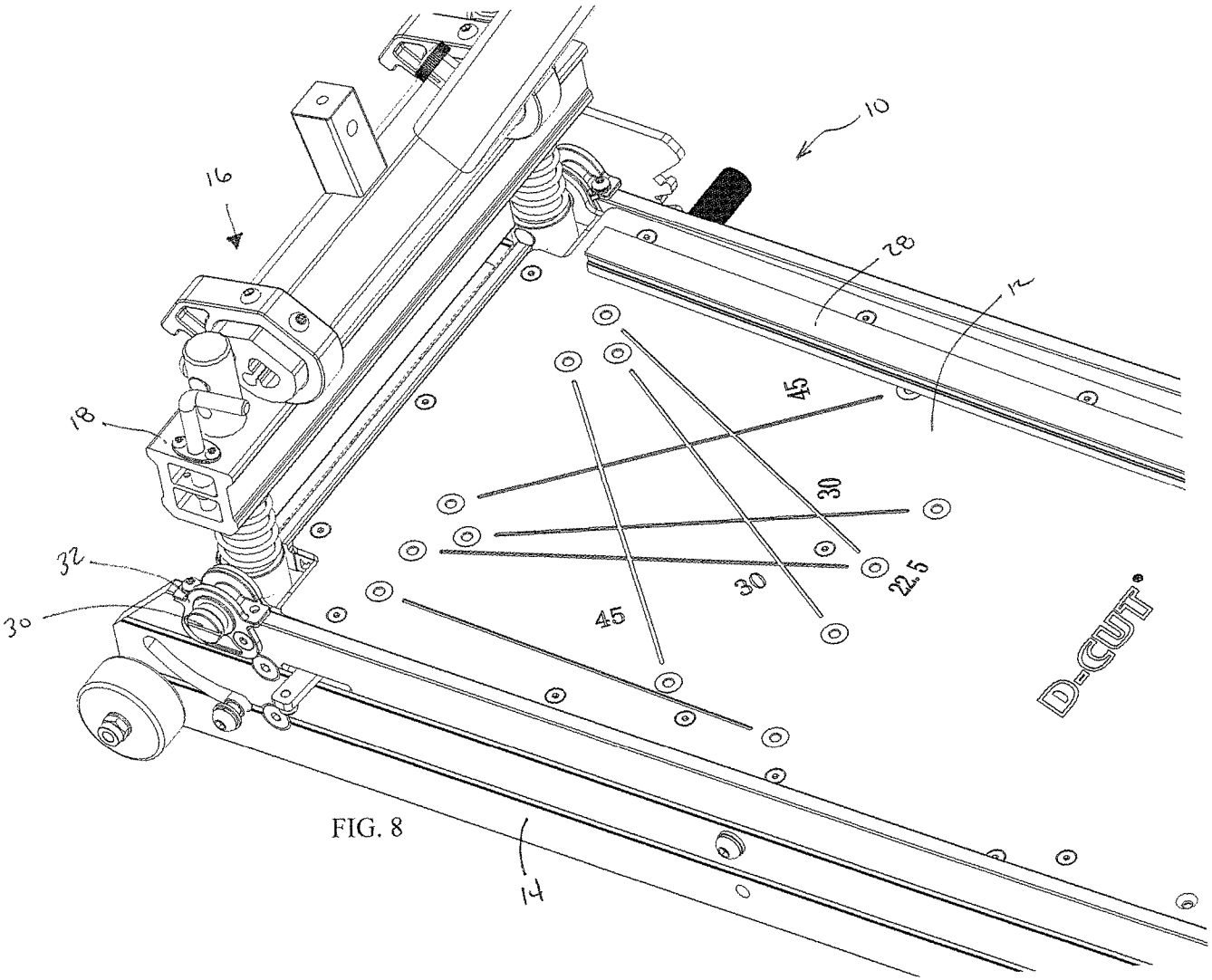
FIG. 8 is a perspective view of the cutting tool shown in FIG. 2 with a plate removed to show interior components.
Figure 9:
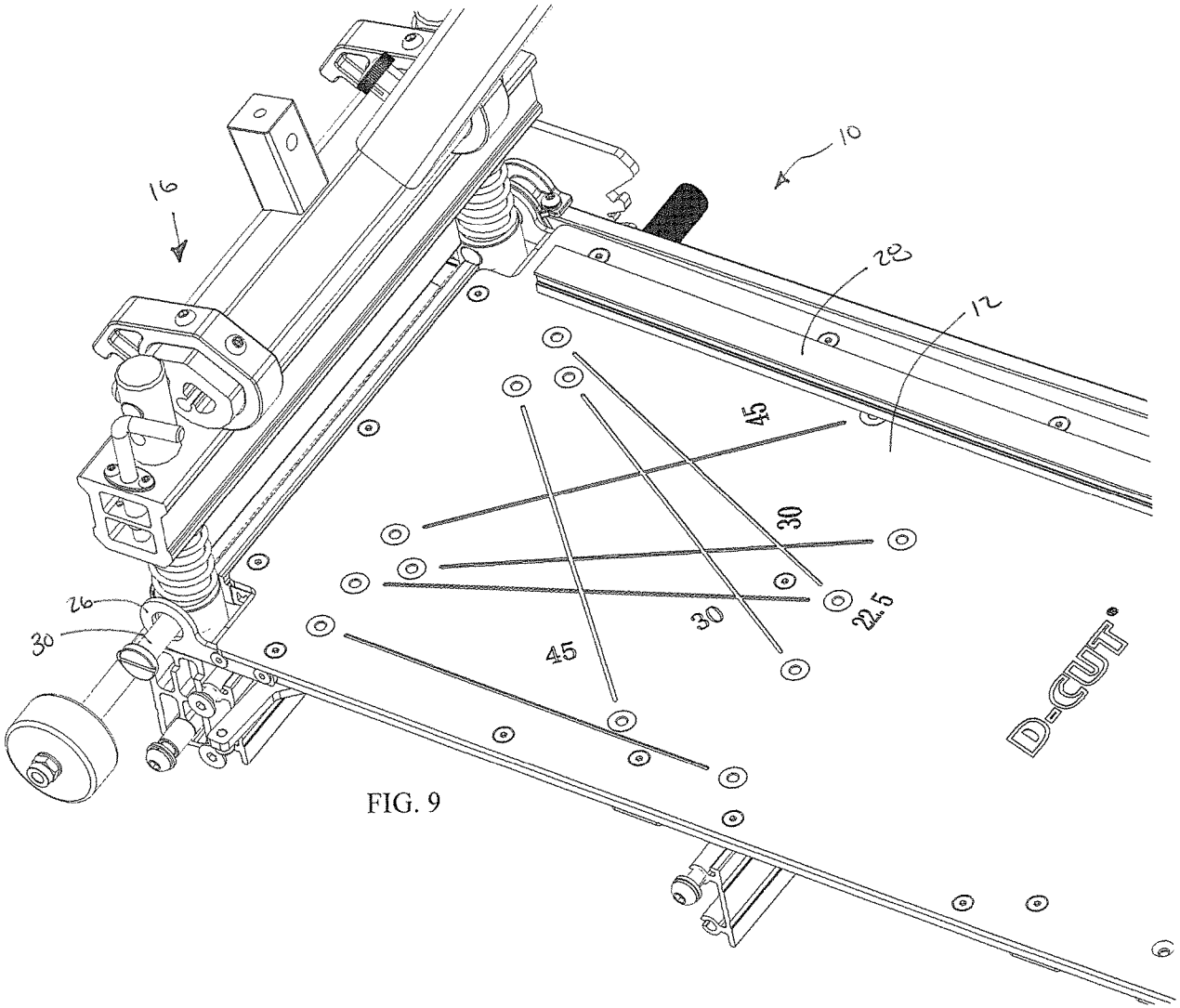
FIG. 9 is a perspective view of the cutting tool shown in FIG. 2 with the plate and a wall of a base removed to show interior components.

As discussed above, the table surface 12, the base 14, and the cutting platform 16 preferably all rotate about the same axis of rotation. In one embodiment of this invention, as best shown in FIGS. 8 and 9, the cutting platform 16 includes an axle 30 which allows for rotational movement between the table surface 12, the base 14, and the cutting platform 16. As best shown in FIG. 8, the base 14 includes a hub 32 that surrounds the axle 30 and allows the cutting platform 16 to rotate relative to the base. As best shown in FIG. 9, the table surface 12 includes a receiver 26 that surrounds the axle 30 and allows the table surface to rotate relative to the cutting platform 16 and/or the base 14.

Figure 3:
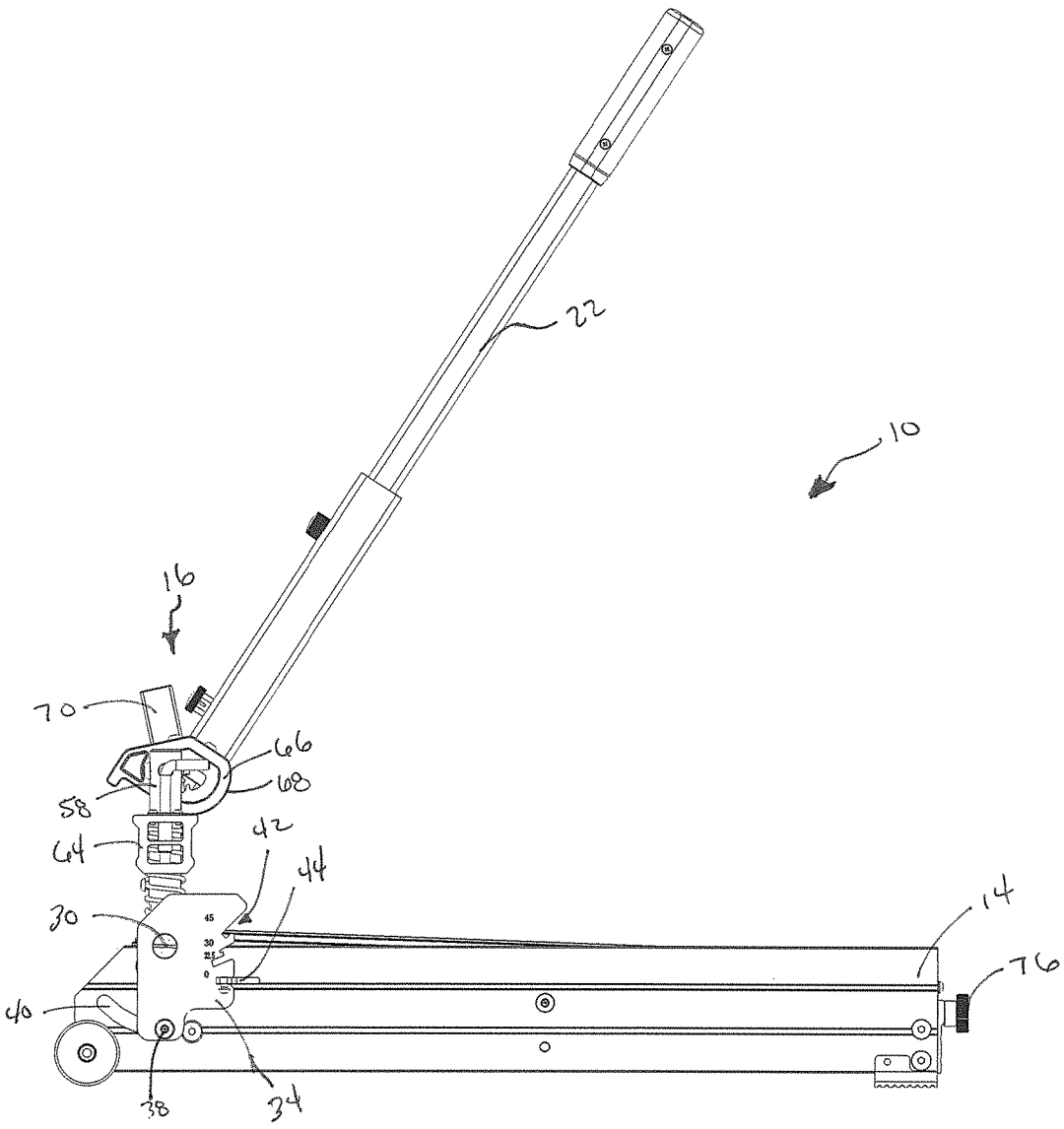
FIG. 3 is a side view of the cutting tool shown in FIG. 2.
Figure 4:
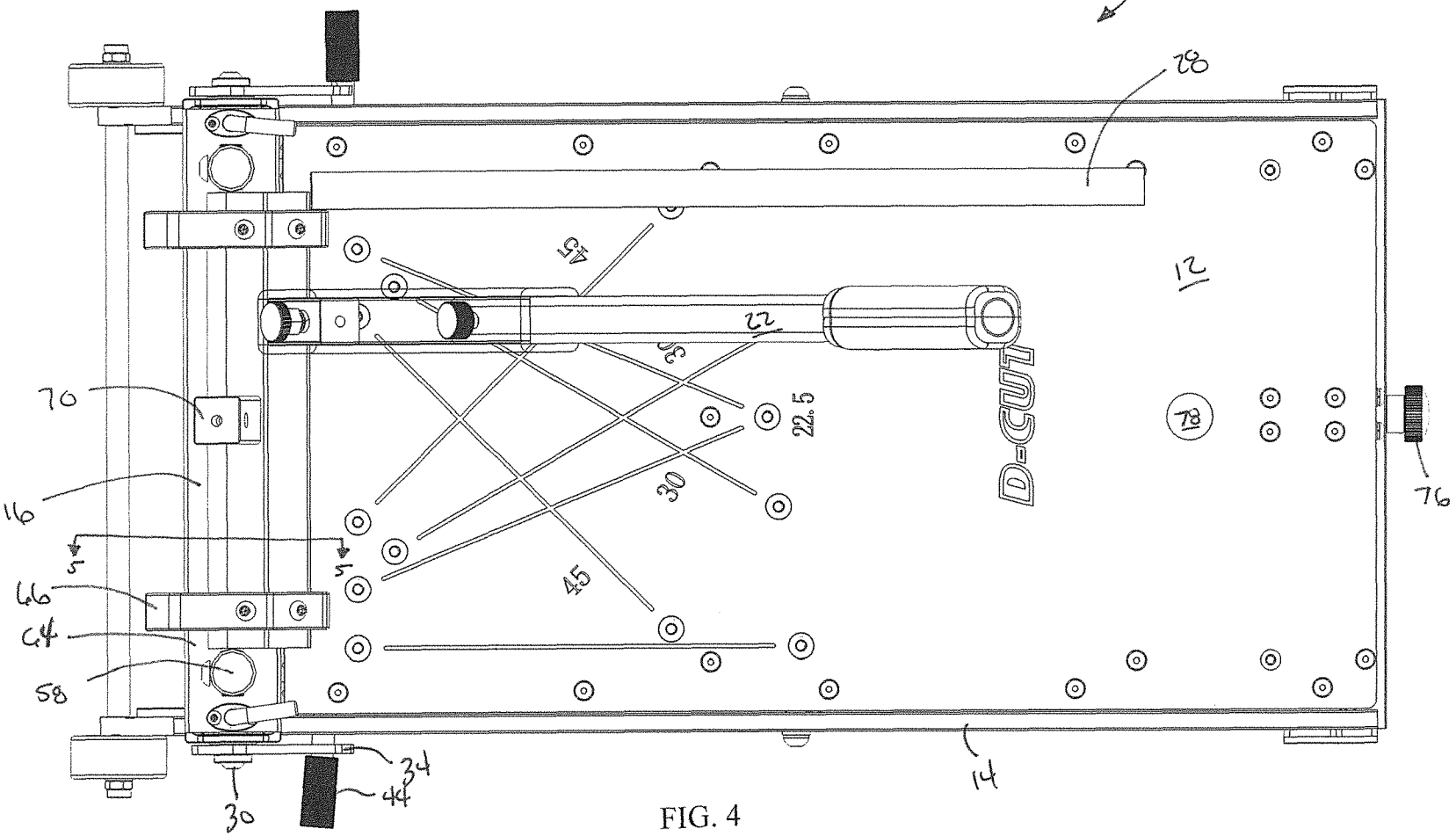
FIG. 4 is a top view of the cutting tool shown in FIG. 2.
Figure 6:
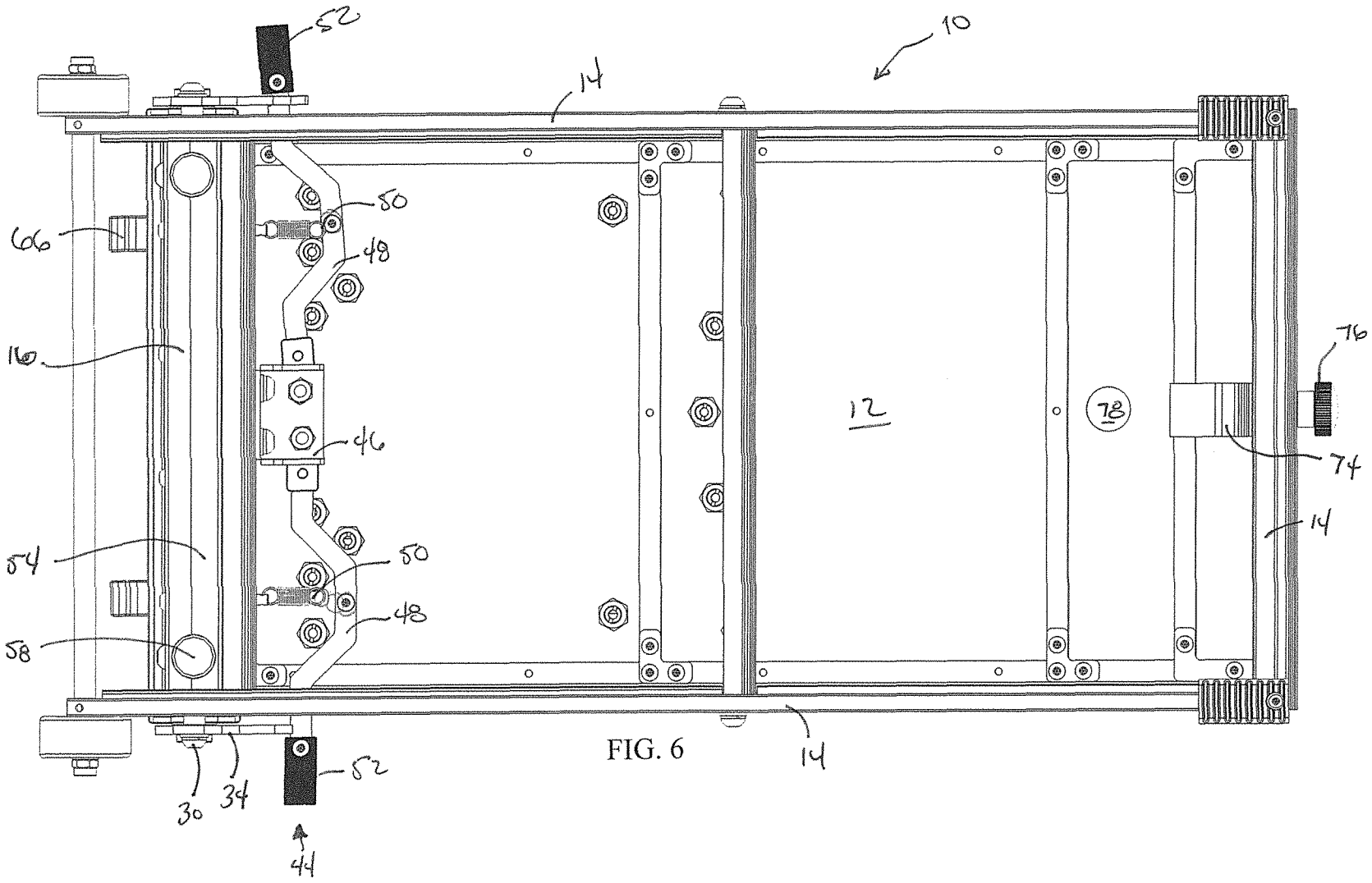
FIG. 6 is a bottom view of the cutting tool shown in FIG. 2.

The cutting tool 10 of this invention preferably includes a device for locking a position of the cutting platform 16 relative to the base 14. In a preferred embodiment, the cutting tool 10 includes a plate 34 rigidly connected to an end of the axle 30 and a latch 44 mounted to the base 14. The latch 44 preferably moves to engage the plate 34 to lock the position of the cutting platform 16 relative to the base 14. As best shown in FIG. 3, the plate 34 further includes a plurality of slots 42 positioned along an edge of the plate for locking the cutting platform 16 and the blade 20 at an angle to the base 14. The plate 34 is locked in a position when the latch 44 is positioned into one of the plurality of slots 42. To set the blade 20 to cut at a desired angle, the latch 44 is disengaged from the slot 42, the plate 34 and the cutting platform 16 are rotated about the axle 30 to a desired angle and the latch 44 is re-engaged with another of the plurality of slots 42. For example, from the perpendicular angle shown in FIG. 2 to the 45° angle shown in FIG. 11. As best shown in FIG. 6, the latch 44 comprises an anchor point 46, a pair of latch arms 48, a spring 50, and a latch grip 52. As shown, the anchor point 46 is connected to the base 14 and the latch arm 48 is pivotally connected to the anchor point 46. The latch arm 48 is biased towards engagement with the slot 42 by the spring 50. In this embodiment, the latch 44 includes a latch on each side, however a single latch may be used. In this embodiment, the plate 34 further includes a guide pin 38 extending through a range limiter 40 in the base 14. The guide pin 38 and the range limiter 40 may be used to restrict the overall movement of the cutting platform 16 relative to the base 14. In this embodiment, the cutting platform is restricted from 0 to 45°. However, the cutting platform of this invention is not limited to this range and may be designed to pivot through a different range of angles.

As discussed in the background, sometimes, for example when there is an imperfection in the underlying walls that the building materials 100 are joined to, a user will adjust an angle of the cut by a small amount to allow a pair of abutting pieces to properly join. The cutting tool 10 of this invention allows for slight adjustment of the cutting angle by changing an angle of the table surface 12 relative to at least one of the base 14 and the cutting platform 16. As best shown in FIG. 9, the table surface 12 is pivotally connected to the axle 30 of the cutting platform 16 with the receiver 26 that allows the table surface 12 to rotate about the axle 30. In a preferred embodiment, the table surface 12 includes a pair of table surface receivers 26, one on each side of the table surface 12, to join the axle 30 on either side of the cutting platform 16.

Figure 10:
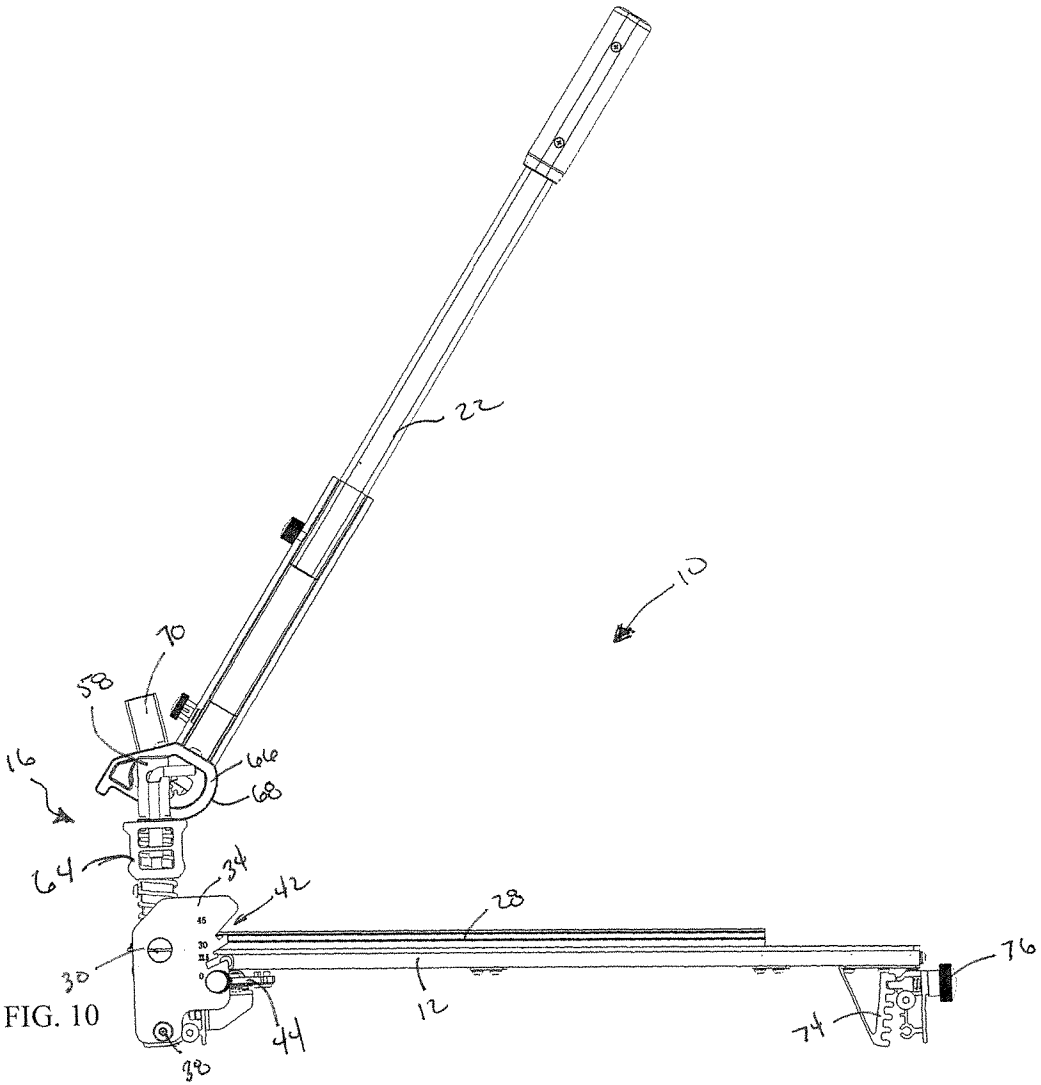
FIG. 10 is a side view of the cutting tool shown in FIG. 2 with the wall of a base removed to show interior components.
Figure 13:
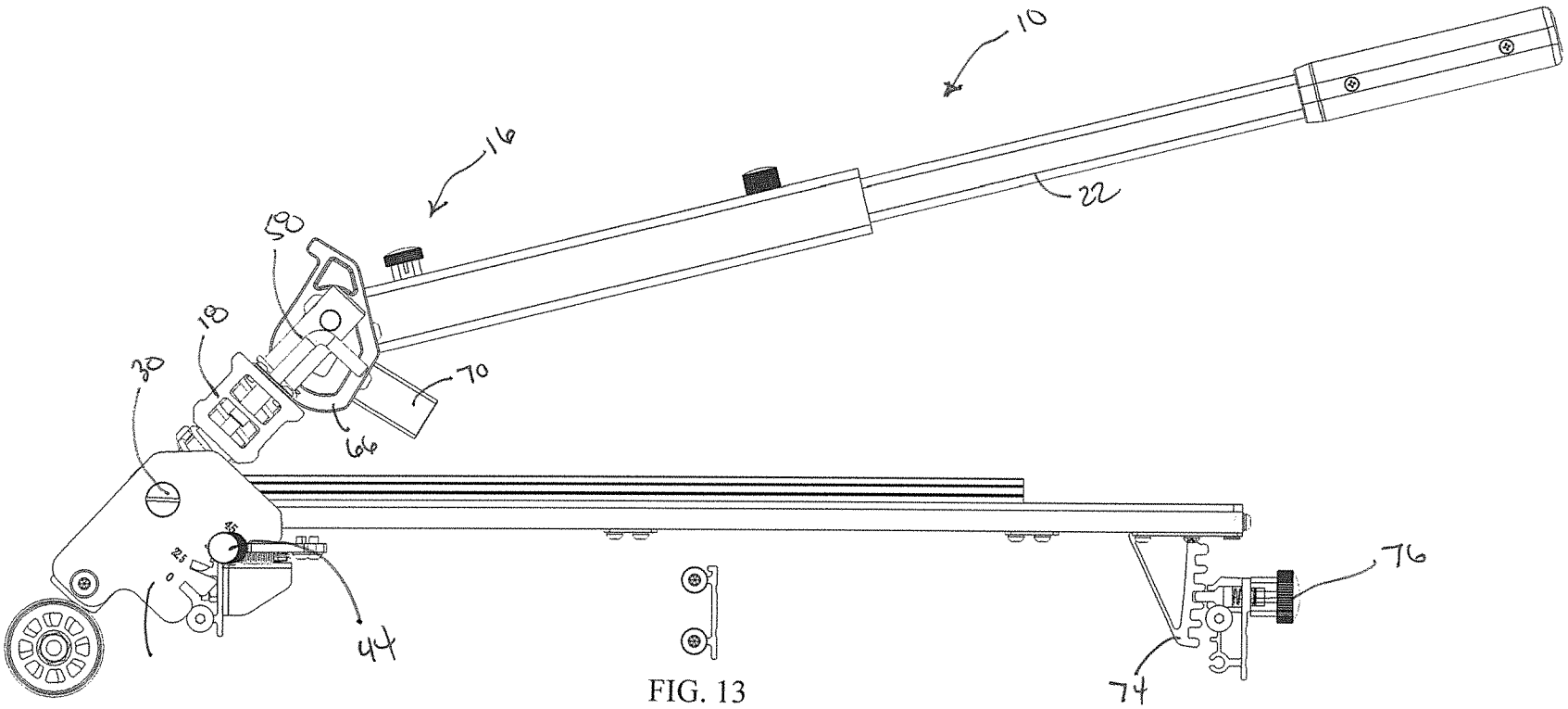
FIG. 13 is a side view of the cutting tool shown in FIG. 11 with a wall of a base removed to show interior components.
Figure 14:
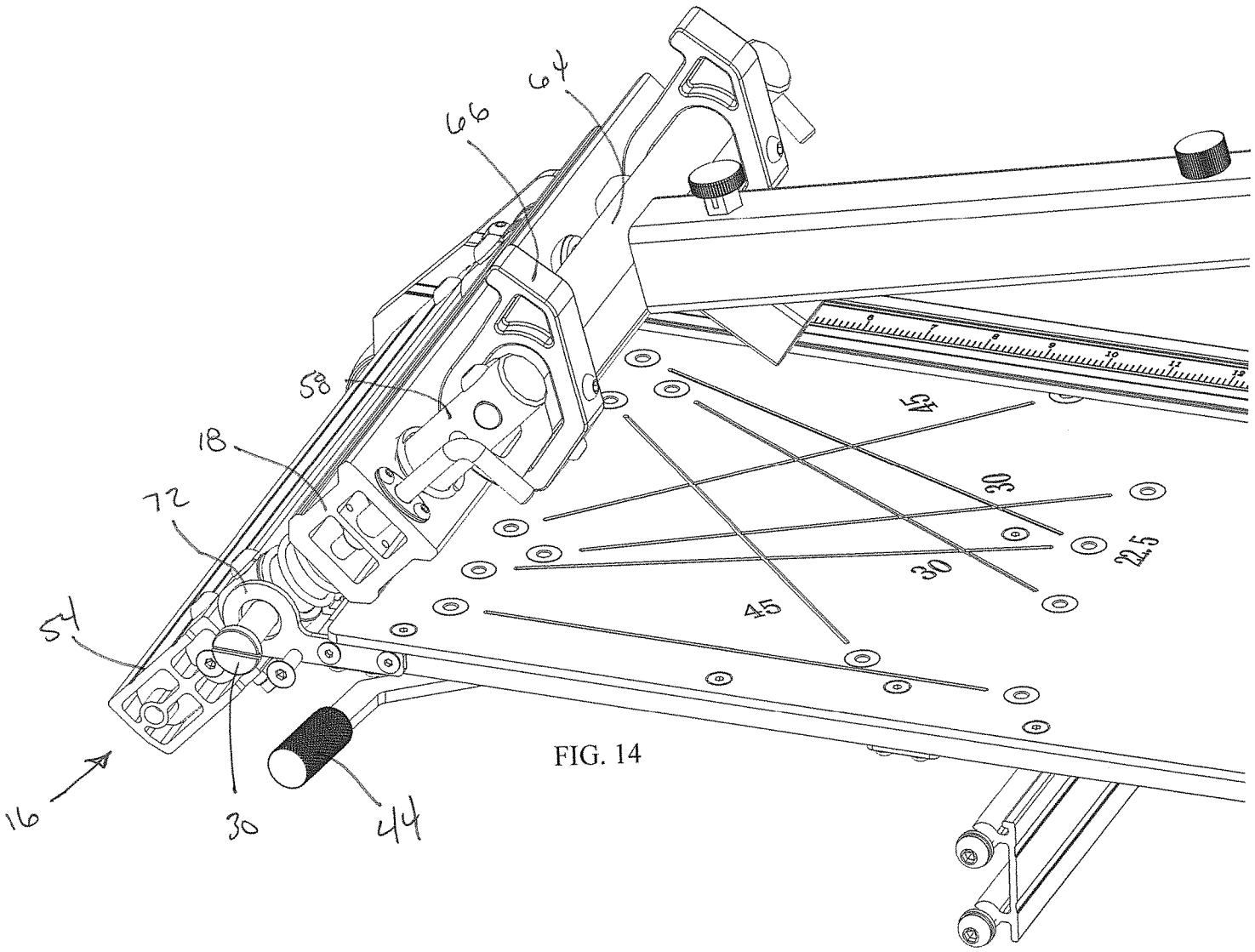
FIG. 14 is a perspective view of a portion of the cutting tool shown in FIG. 11 with the wall of the base removed to show interior components.
Figure 17:
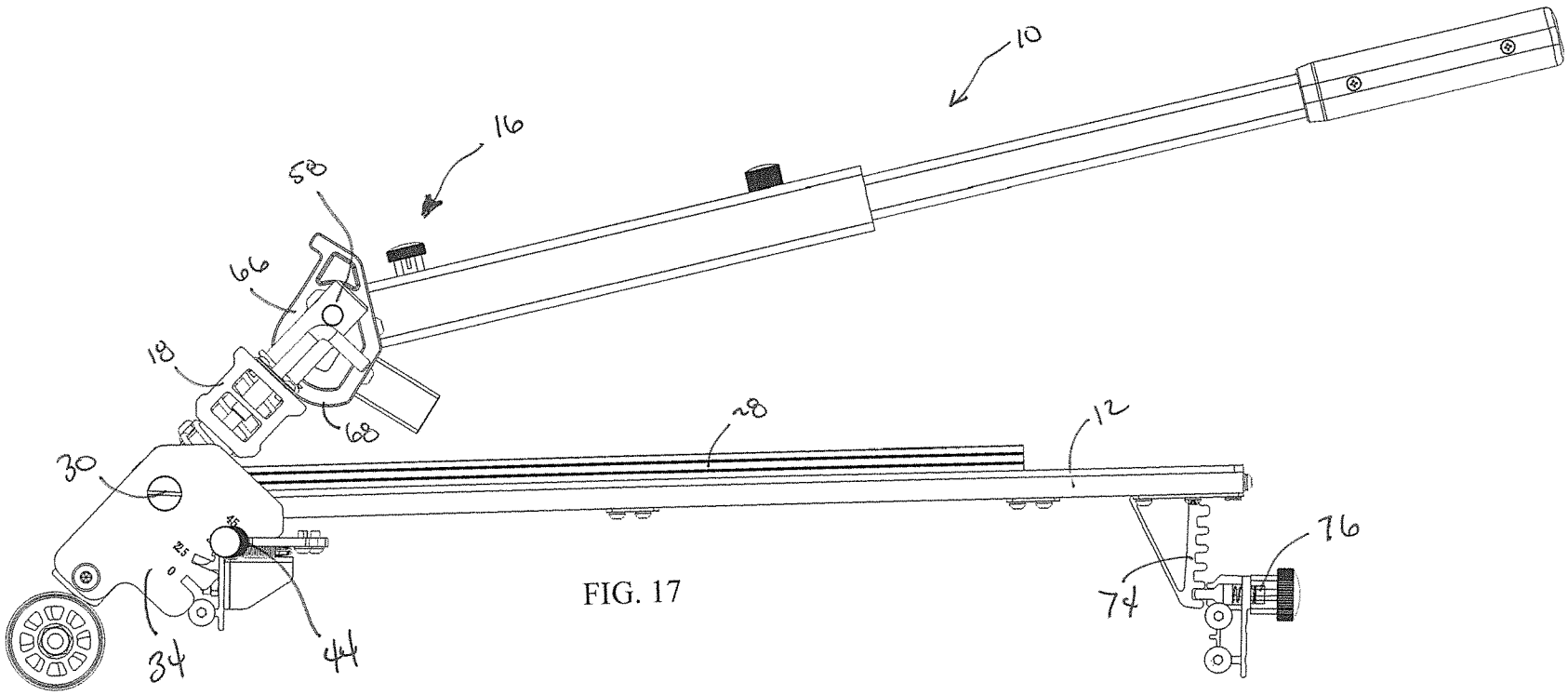
FIG. 17 is a side view of the cutting tool shown in FIG. 15 with a wall of a base removed to show interior components.

Preferably, the table surface 12 is connected to the cutting tool at the axle 30, as discussed above, and to the base 14 with an adjustable, lockable connection allowing the table surface 12 to be set at plurality of angles relative to the cutting platform 16. In one embodiment, as shown in FIGS. 10, 13, and 17, the adjustable connection comprises a rack 74 mounted to a bottom surface of the table surface 12 and a releasable plunger connector 76 mounted to the base. In this embodiment, the rack 74 includes five grooves allowing the table surface to be set at +2°, +1°, 0, −1°, −2°. However, it should be understood that this invention is not limited to a five groove rack 74 and that a rack with more grooves and/or wider or finer grooves, may be used. The releasable plunger connector 76 is preferably biased towards the rack 74 with a spring and the releasable plunger connector 76 can be pulled away from rack 74 and reset to another position on the rack 74 to adjust an angle of the table surface 12. For example, in FIG. 10, the releasable plunger connector 76 is positioned in a top groove of the rack 74, setting the table surface 12 at a +2° angle. With this setting and the cutting platform 16 set to a 45° angle, the resulting cut will be 47°. In another example, shown in FIG. 13, the releasable plunger connector 76 is positioned in the third or middle groove of the rack 74, setting the table surface at a neutral position (0). In a third example, shown in FIG. 17, the releasable plunger connector 76 is positioned in the fifth or lowest groove of the rack 74, setting the table surface at a −2° angle. With this setting and the cutting platform 16 set to a 45° angle, the resulting cut will be 43°.

In a preferred embodiment, the table surface 12 may include an aperture 78 to assist in lowering or raising the table surface 12. In other embodiments of this invention, the table surface angle may be adjusted using another type of mechanism.

Figure 5:
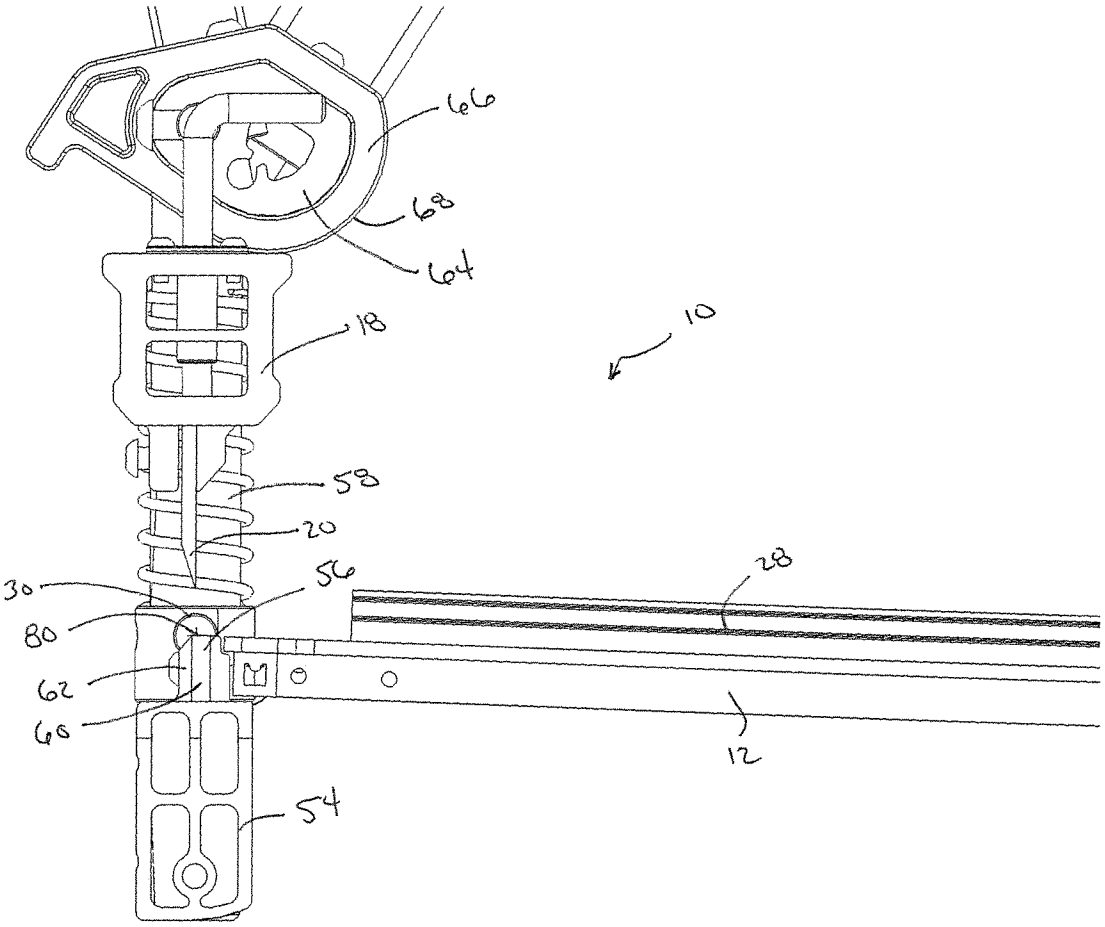
FIG. 5 is a cross-sectional view of the cutting tool along a line shown in FIG. 4.

In a preferred embodiment, as shown in the cross-sectional view of FIG. 5, the blade stop 56 includes a contact element 60 and a brace 62. The contact element 60 is preferably manufactured of a softer material that causes minimal damage to an edge of the blade 20 such as, but not limited to, nylon. The brace 62 is preferably manufactured of a durable material such as, but not limited to, steel and aluminum. Preferably, the contact element 60 and the brace 62 are connected to the cutting platform base 54 with a threaded connection that allows the contact portion to be easily replaced as it wears. In a preferred embodiment, the brace 62 includes a sloped top edge. This sloped edge prevents the blade stop from projecting over a plane of the table surface 12 as the cutting platform 16 and/or the table surface 12 are set to an angle other than 0°.

As discussed above, the table surface 12, the base 14, and the cutting platform 16 preferably all rotate about the same axis of rotation. In a preferred embodiment, as shown in FIG. 5, the blade 20 contacts the blade stop 56 in the cutting platform base 54 along a line that is collinear with a center 80 of the axis of rotation. FIG. 5 shows a close-up, cross sectional view of the center 80 of the axis of rotation. This arrangement maintains the alignment of the blade 20 to provide a straight cut through the material 100, regardless of the selected angle of the cutting platform 16 and/or the table surface and prevents movement, splintering and/or cracking of the material.

In operation, a user of the cutting tool 10 of this invention selects a desired angle of cut, for example right, 22.5°, 30°, and 45°, and releases the latch 44 from the slot 42 and rotates the cutting platform 16 to the selected angle relative to the base 14. The latch 44 is pivoted into the selected slot 42 locking the cutting tool 10 in the selected angle. The user then determines if the selected angle needs to be adjusted slightly up or down. If so, the releaseable plunger connector 76 is pulled, disengaging the plunger from the rack 74. The table surface 12 is pivoted to the desired adjustment angle and the releaseable plunger connector 76 is released, reengaging with the rack 74, locking the table surface 12 relative to the base 14. The cutting tool 10 of this invention starts in the open position. In the open position, the spring 66 biases the blade holder 18 and the blade 20 upward and the cam 66 contacts the blade holder 18 at a relatively small radius, providing an opening between the blade 20 and the cutting platform base 54. The material 100 to be cut is placed onto the table surface 12 and through the opening formed between the blade 18 and the cutting platform 16. To cut the material 100, the handle 22 is lowered to rotate the cam 66. By rotating the cam 66, a gradually increasing radius of the cam edge 68 pushes the blade holder 18 and blade 20 downward through the material 100 until a large radius of the cam 66 contacts the blade holder 18 and the blade 20 contacts the blade stop 56 thereby severing the material 100. The resulting cut is optimally free of splinters and a resulting cut end of the material is otherwise clean and straight.

While in the foregoing specification this invention has been described in relation to certain preferred embodiments thereof, and many details have been set forth for purpose of illustration, it will be apparent to those skilled in the art that the material cutter is susceptible to additional embodiments and that certain of the details described herein can be varied considerably without departing from the basic principles of the invention.

What is claimed is:

1. A cutting tool comprising:

a base;

a cutting platform including an axle, the cutting platform pivotally connected to the base with the axle, wherein the cutting platform includes a blade holder with a linear blade, wherein the blade holder and the linear blade are movable between an open position and a cutting position, and wherein the cutting platform can be releasably locked at a plurality of angles to the base;

a table surface pivotally connected to the cutting platform with the axle, wherein the table surface is releasably locked with respect to the base at a plurality of fine adjustment angles.

2. The cutting tool of claim 1, wherein the plurality of angles that the cutting platform can be set to the base includes 0, 22.5°, 30°, and 45°.

3. The cutting tool of claim 2, wherein the fine adjustment angle of the table surface to the linear blade includes +2°, +1°, 0, −1°, and −2°.

4. The cutting tool of claim 1, wherein both the cutting platform and the table surface rotate about the same axis of rotation at a center line of the axle.

5. The cutting tool of claim 4, wherein when the linear blade contacts a blade stop, a tip of the linear blade is aligned with the centerline of the axle.

6. The cutting tool of claim 1, further comprising:

a spring positioned between the blade holder and the cutting platform, the spring biasing the blade holder to the open position.

7. The cutting tool of claim 1, further comprising:

a guide rail positioned on the table surface.

8. The cutting tool of claim 1 further comprising:

a plate secured to an end of the axle, the plate including a plurality of slots, each slot used to set the cutting platform at an angle to the base;

a latch connected to the base; and wherein the latch engages one of the plurality of slots to lock the cutting platform at the angle to the base;

wherein the angle to the base is adapted to a horizontal adjustment; and wherein the angle to the base is adapted to a vertical adjustment.

9. The cutting tool of claim 1 further comprising:

a rack mounted under the table surface, the rack including a plurality of grooves, each groove used to set the table surface at a fine adjustment angle to the base;

a releasable plunger connector mounted to the base; and wherein the releasable plunger connector engages one of the plurality of grooves to lock the table surface at the fine adjustment angle to the base.

10. A cutting device comprising:

a base;

a cutting platform including an axle, the cutting platform pivotally connected to the base at the axle, wherein the cutting platform can be releasably locked at a plurality of angles to the base;

wherein the cutting platform includes a blade holder with a blade, wherein the blade holder and the blade are movable between an open position and a cutting position, wherein a tip of the blade is aligned with a centerline of the axle; and a table surface pivotally connected to the cutting platform at the axle, wherein the table surface is releasably locked with respect to the base at a plurality of fine angles.

11. The cutting device of claim 10, wherein the plurality of angles that the cutting platform can be set to the base includes 0, 22.5°, 30°, and 45°.

12. The cutting device of claim 11, wherein the fine angle of the table surface to the blade includes +2°, +1°, 0, −1°, and −2°.

13. The cutting device of claim 10, wherein both the cutting platform and the table surface rotate about the same axis of rotation at a center line of the axle.

14. The cutting device of claim 10 further comprising:

a plate secured to an end of the axle, the plate including a plurality of slots, each slot used to set the cutting platform at an angle to the base;

a latch connected to the base; and wherein the latch engages one of the plurality of slots to lock the cutting platform at the angle to the base.

15. The cutting device of claim 10 further comprising:

a rack mounted under the table surface, the rack including a plurality of grooves, each groove used to set the table surface at a fine adjustment angle to the base, the fine adjustment angle adapted to more precisely cut a measured angle with the blade;

a releasable plunger connector mounted to the base; and wherein the releasable plunger connector engages one of the plurality of grooves to lock the table surface at the fine adjustment angle to the base.

* * * * *